US009153087B2

(12) United States Patent
Yamamoto et al.

(10) Patent No.: US 9,153,087 B2
(45) Date of Patent: Oct. 6, 2015

(54) COIN PROCESSING DEVICE

(71) Applicant: LAUREL PRECISION MACHINES CO., LTD., Osaka-shi, Osaka (JP)

(72) Inventors: Shohei Yamamoto, Nagareyama (JP); Takaaki Nakazawa, Yokohama (JP)

(73) Assignee: LAUREL PRECISION MACHINES CO., LTD., Osaka (JP)

( * ) Notice: Subject to any disclaimer, the term of this patent is extended or adjusted under 35 U.S.C. 154(b) by 0 days.

(21) Appl. No.: 14/614,770

(22) Filed: Feb. 5, 2015

(65) Prior Publication Data

US 2015/0228141 A1 Aug. 13, 2015

(30) Foreign Application Priority Data

Feb. 10, 2014 (JP) ..... 2014-023673

(51) Int. Cl.
*G07D 5/08* (2006.01)
*G07D 5/00* (2006.01)
*G07D 7/04* (2006.01)

(52) U.S. Cl.
CPC .. *G07D 5/08* (2013.01); *G07D 5/00* (2013.01); *G07D 7/04* (2013.01); *G07D 2205/0012* (2013.01)

(58) Field of Classification Search
CPC .... G07D 5/00; G07D 5/08; G07D 2205/0012
USPC ..... 194/303, 320, 344
See application file for complete search history.

(56) References Cited

U.S. PATENT DOCUMENTS

2011/0209967 A1* 9/2011 Toji ..... 194/320

FOREIGN PATENT DOCUMENTS

JP 2001-143119 5/2001
JP 2011-248775 A 12/2011

OTHER PUBLICATIONS

Extended European Search Report mailed Jul. 10, 2015 in European Application No. 15153904.6 (4 pages).

* cited by examiner

*Primary Examiner* — Mark Beauchaine
(74) *Attorney, Agent, or Firm* — Nixon & Vanderhye P.C.

(57) ABSTRACT

A coin processing device includes: a conveying unit that conveys a coin in a conveyance direction; first and second material sensors detect material of the conveyed coin to obtain material detection data; first and second position sensors detect a position of the conveyed coin to obtain position detection data; a correcting unit that corrects the material detection data based on the position detection data to obtain corrected material detection data; and an identifying unit that identifies the conveyed coin based on the corrected material detection data.

6 Claims, 3 Drawing Sheets

COIN PROCESSING DEVICE

BACKGROUND OF THE INVENTION

1. Field of the Invention

The present invention relates to a coin processing device.

Priority is claimed on Japanese Patent Application No. 2014-023673, filed Feb. 10, 2014, the content of which is incorporated herein by reference.

2. Description of Related Art

There is known a coin identifying device that detects magnetic data with a magnetic sensor based on a timing of detecting coins with a timing sensor, and identifies the denomination of a coin based on the magnetic data (for example, refer to Japanese Unexamined Patent Application, First Publication No. 2001-143119).

There is a coin processing device that adjusts the interval of opposing guide walls of a conveying unit to a passage width corresponding to the counting target denomination, and while conveying a coin between these guide walls identifies with a material sensor whether or not it is a coin of the counting target denomination and counts it accordingly. In this kind of coin processing device, there is a possibility of the identification accuracy decreasing when the adjustment accuracy of the interval between the opposing guide walls is insufficient.

SUMMARY OF THE INVENTION

An object of the present invention is to provide a coin processing device that can inhibit a drop in the identification accuracy when the passage width of the conveying unit is adjustable.

A coin processing device according to the present invention includes an operation unit, a conveying unit, first and second material sensors, first and second position sensors, a correcting unit, and an identifying unit. The operation unit receives an input of a denomination. The conveying unit conveys a coin in a conveyance direction. The conveying unit includes first and second guide walls opposing to each other in a passage width direction substantially orthogonal to the conveying direction. The first and second guide walls sandwich the conveyed coin therebetween. An interval between the first and second guide walls is adjusted to a passage width corresponding to the inputted denomination. The first and second material sensors are provided spaced apart in the passage width direction. Positions of the first and second material sensors are aligned with each other in the conveyance direction. The first and second material sensors detect material of the conveyed coin to obtain material detection data related to the conveyed coin. The first and second position sensors are provided spaced apart in the passage width direction. Positions of the first and second position sensors are aligned with the positions of the first and second material sensors in the conveyance direction. The first and second position sensors detect a position of the conveyed coin in the passage width direction to obtain position detection data related to the conveyed coin. The correcting unit corrects the material detection data based on the position detection data to obtain corrected material detection data. The identifying unit identifies the conveyed coin based on the corrected material detection data.

According to the above structure, the positions of the first and second position sensors are aligned with the positions of the first and second material sensors in the conveyance direction. The correcting unit corrects the material detection data based on the position detection data to obtain corrected material detection data. The identifying unit identifies the conveyed coin based on the corrected material detection data. Thereby, it is possible to inhibit a drop in the identification accuracy when the passage width of the conveying unit (that is, the interval between the first and second guide walls) is adjustable.

In the above-described coin processing device, the conveyed coin may be a second coin. The conveying unit may further convey a first coin. The first and second material sensors may detect the first coin to obtain material detection data related to the first coin. The first and second position sensors may detect the first coin to obtain position detection data related to the first coin. The correcting unit may use the position detection data related to the first coin as reference data in one identification process, and may correct the material detection data related to the second coin based on the reference data and the position detection data related to the second coin.

According to the above structure, the correcting unit uses the position detection data related to the first coin as reference data in one identification process. That is, the detection data that the first and second position sensors detected for the first coin serve as reference data. Thus, the detection data of the first coin that is actually conveyed in the passage width after adjustment of the conveying unit can be used as reference data. Thereby, the reference data conforms to the actual passage width, and so it is possible to further inhibit a drop in the identification accuracy.

In the above-described coin processing device, the first material sensor and the first position sensor may be provided on an opposite side of the conveying unit from the second material sensor and the second position sensor. The position detection data related to the first coin may include: position detection data related to the first coin obtained by the first position sensor, which is denoted as x0; and position detection data related to the first coin obtained by the second position sensor, which is denoted as y0. The position detection data related to the second coin may include: position detection data related to the second coin obtained by the first position sensor, which is denoted as x; and position detection data related to the second coin obtained by the second position sensor, which is denoted as y. The material detection data related to the second coin may include: material detection data related to the second coin obtained by the first material sensor, which is denoted as Dx; and material detection data related to the second coin obtained by the second material sensor, which is denoted as Dy. The correcting unit may calculate reference value b using a formula of $b=y0+x0$. The correcting unit may calculate a calculation value a using a formula of $a=y/x$. The correcting unit may calculate correction values difx and dify using a formula of $difx=x-b/(a+1)$ and a formula of $dify=y-a*b/(a+1)$. The correcting unit may subtract the correction value difx from the material detection data Dx and subtract the correction value dify from the material detection data Dy, as the correction of the material detection data related to the second coin.

According to the above structure, the reference value b ($=y0+x0$) is calculated from the position detection data x0 related to the first coin obtained by the first position sensor and the position detection data y0 related to the first coin obtained by the second position sensor. The calculation value a ($=y/x$) is calculated from the position detection data x related to the second coin obtained by the first position sensor and the position detection data y related to the second coin obtained by the second position sensor. The correction values difx ($=x-b/(a+1)$) and dify ($=y-a*b/(a+1)$) are calculated from the calculation value a and the reference value b. The correcting unit subtracts the correction value difx from the material detection data Dx and subtracts the correction value dify from the material detection data Dy, as the correction of the material detection data related to the second coin. Thereby, it is possible to comparatively easily correct the detection data of the material sensors.

In the above-described coin processing device, the first material sensor and the first position sensor may be provided on an opposite side of the conveying unit from the second material sensor and the second position sensor. The position detection data related to the first coin may include: position detection data related to the first coin obtained by the first position sensor, which is denoted as x0; and position detection data related to the first coin obtained by the second position sensor, which is denoted as y0. The position detection data related to the second coin may include: position detection data related to the second coin obtained by the first position sensor, which is denoted as x; and position detection data related to the second coin obtained by the second position sensor, which is denoted as y. The material detection data related to the second coin may include: material detection data related to the second coin obtained by the first material sensor, which is denoted as Dx; and material detection data related to the second coin obtained by the second material sensor, which is denoted as Dy. The correcting unit may calculate reference value b using a formula of $b=y0+x0$. The correcting unit may calculate a calculation value c using a formula of $c=y-x$. The correcting unit may calculate correction values difx and dify using a formula of $difx=x-(b-c)/2$ and a formula of $dify=y-(b+c)/2$. The correcting unit may subtract the correction value difx from the material detection data Dx and subtract the correction value dify from the material detection data Dy, as the correction of the material detection data related to the second coin.

According to the above structure, the reference value b ($=y0+x0$) is calculated from the position detection data x0 related to the first coin obtained by the first position sensor and the position detection data y0 related to the first coin obtained by the second position sensor. The calculation value c ($=y-x$) is calculated from the position detection data x related to the second coin obtained by the first position sensor and the position detection data y related to the second coin obtained by the second position sensor. The correction values difx ($=x-(b-c)/2$) and dify ($=y-(b+c)/2$) are calculated from the calculation value c and the reference value b. The correcting unit subtracts the correction value difx from the material detection data Dx and subtracts the correction value dify from the material detection data Dy, as the correction of the material detection data related to the second coin. Thereby, it is possible to comparatively easily correct the detection data of the material sensors.

In the above-described coin processing device, the conveying unit may further convey a third coin. The first and second material sensors may detect the third coin to obtain material detection data related to the third coin. The first and second position sensors may detect the third coin to obtain position detection data related to the third coin. The correcting unit may use an average value of the position detection data related to the first coin and the position detection data related to the second coin, and correct the material detection data related to the third coin based on the average value and the position detection data related to the third coin.

DETAILED DESCRIPTION OF THE INVENTION

Figure 1:
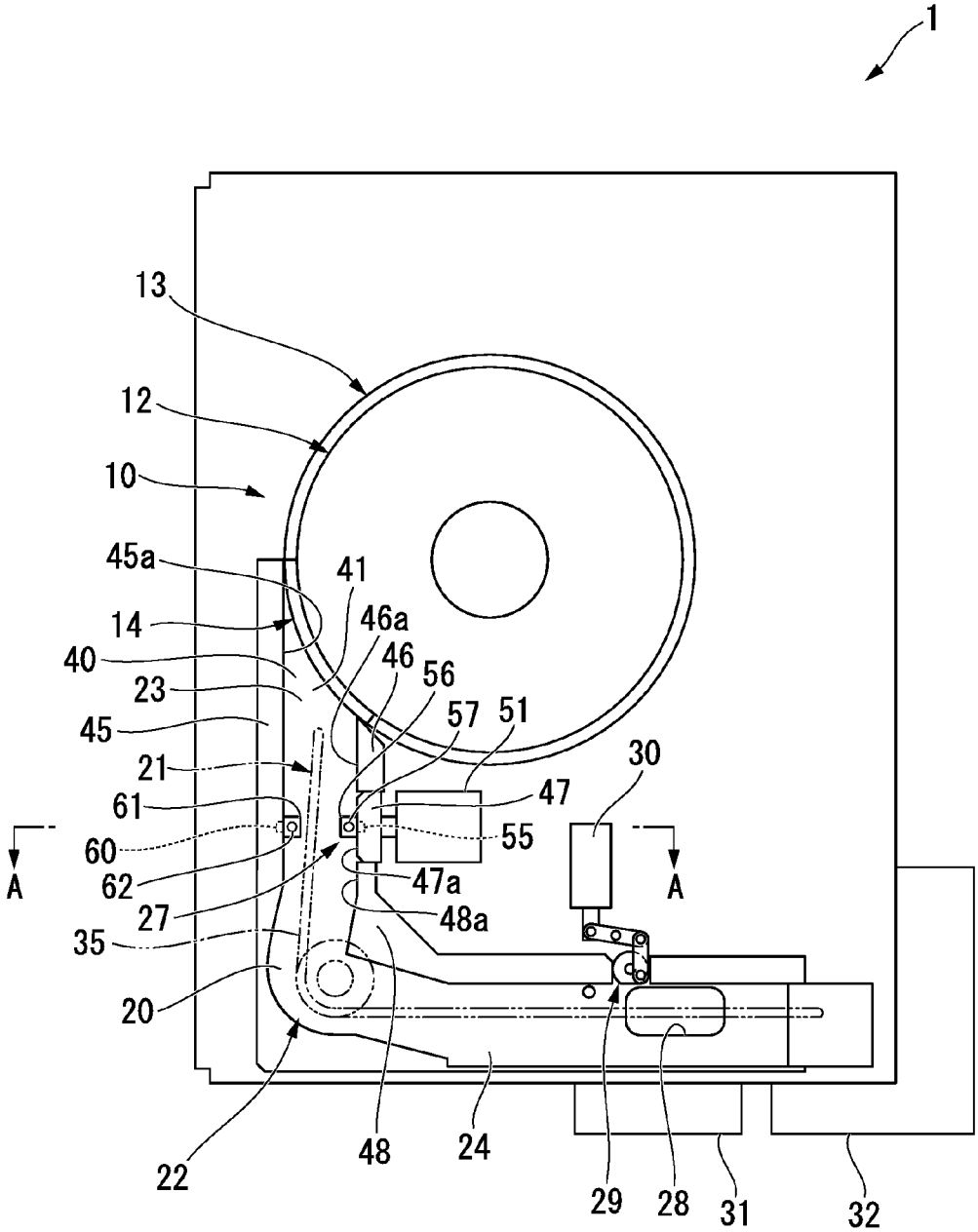
FIG. 1 is a plan view that shows a coin processing device according to one embodiment of the present invention.

A coin processing device according to one embodiment of the present invention shall be described below referring to the drawings.

A coin processing device according to the present embodiment is a coin processing device that counts coins of a set denomination while identifying whether or not loose coins inserted from outside the machine are coins of the set denomination, and moreover sorts them into coins of the set denomination and other coins.

As shown in FIG. 1, the coin processing device 1 according to the present embodiment has a coin insertion-payout unit 10 in which loose coins are inserted from outside.

The coin insertion-payout unit 10 has a rotating disk 12, cylindrical wall 13, and a separating ring 14. The rotating disk 12 is installed horizontally. The cylindrical wall 13 has approximately cylindrical shape, rises perpendicularly from the outer edge of the rotating disk 12. A portion of the cylindrical wall 13 is cutaway. The separating ring 14 has a gap of one coin between the separating ring 14 and the rotating disk 12. The separating ring 14 is provided at the cutaway portion of the cylindrical wall 13. The rotating disk 12 rotates by being driven by a rotating disk motor 15 shown in FIG. 2.

Loose coins are inserted from outside the machine into the coin insertion-payout unit 10. When the rotating disk 12 rotates counter clockwise in FIG. 1 in this state, the coins are carried by centrifugal force along the inner circumference surface of the cylindrical wall 13. Moreover, the coins are separated one by one via the gap between the rotating disk 12 and the separating ring 14 to be paid out sequentially from the coin insertion-payout unit 10 to the outside of the rotating disk 12.

At the coin payout position of the coin insertion-payout unit 10, a conveying unit 22 is provided. The conveying unit 22 has a conveyance path 20 and a feed unit 21. The conveyance path 20 guides the coins paid out from the coin insertion-payout unit 10 in a single row. The feed unit 21 conveys the coins on the conveyance path 20.

The conveyance path 20 has a conveyance path unit 23 and a conveyance path unit 24. The conveyance path unit 23 is arranged along the tangential direction of the rotating disk 12. The conveyance path unit 24 extends in a perpendicular direction from the opposite side of this conveyance path unit 23 from the rotating disk 12. An identifying unit 27 is provided in the conveyance path unit 23, and identifies the denomination of a coin being conveyed and counts it is.

The conveyance path unit 24 has a rejection port 28 and a rejecting unit 29. The rejection port 28 is capable of dropping coins and guides the dropped coins so as to be extractable outside the machine. The rejecting unit 29 causes coins that are identified as being unidentifiable by the identifying unit 27 to drop from the rejection port 28. The rejecting unit 29 is driven by a rejection solenoid 30. Coins that have dropped from the rejection port 28 are housed in a reject box 31, and coins that have not dropped from the rejection port 28 are housed in a receiving box 32 from a terminal position of the housing path unit 24. The receiving box 32 is separate from the reject box 31.

Figure 2:
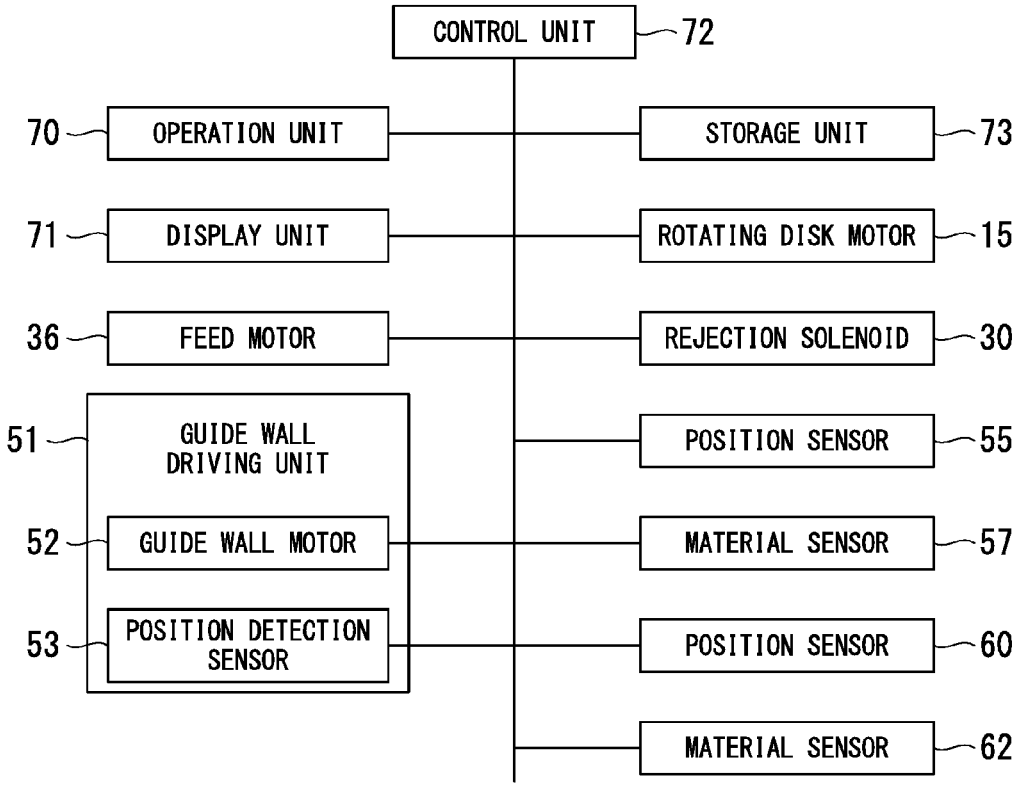
FIG. 2 is a block diagram of a control system of the coin processing device according to the one embodiment of the present invention.

The feed unit 21 has a conveying belt 35 and a feed motor 36 shown in FIG. 2 that drives the conveying belt 35. The conveying belt 35 conveys coins paid out from the coin insertion-payout unit 10 by pressing them against the conveyance path 20 from the upper side. During transport of coins, the identifying unit 27 identifies whether coins are of the set denomination, and counts coins of the set denomination. Coins that are identified by the identifying unit 27 as being other than the set denomination are made to drop to the reject box 31 from the rejection port 28 by the rejecting unit 29. Coins that are identified by the identifying unit 27 as being of the set denomination are made to drop to the receiving box 32 from the terminal position of the conveyance path unit 24.

Here, in the conveyance path unit 23, the horizontal direction that is perpendicular (or substantially perpendicular) to the coin conveyance direction (conveyance direction) of the conveyance path unit 23 is defined as the passage width direction. The conveyance path unit 23 has a passage unit 41, a guide wall 45, and guide walls 46, 47, 48. The passage unit 41 extends in a straight line in the tangential direction of the rotating disk 12 and has a conveying surface 40 that is the upper surface thereof and is arranged horizontally. The guide wall 45 is provided on one side in the passage width direction of the passage unit 41 and extends in the same direction as the passage unit 41. The guide walls 46, 47, 48 are provided on the other side of the passage width direction of the passage unit 41 and extend in the same direction as the passage unit 41. That is to say, the guide wall 45 is opposing to the guide walls 46, 47, 48 in the passage width direction with sandwiching the conveying surface 40 therebetween.

The position of the guide wall 45 is fixed with respect to the passage unit 41. The guide walls 46, 47, 48 are arranged along the coin conveyance direction of the conveyance path unit 23. The guide wall 46 is arranged on one side of the guide wall 47. The guide wall 48 is arranged on the other side of the guide wall 47. That is to say, the guide wall 47 is arranged between the guide walls 46 and 48. The positions of the guide walls 46 and 48 are also fixed with respect to the passage unit 41. The guide wall 47 is movable in the passage width direction with respect to the passage unit 41. The guide wall 45 has a wall surface 45*a* on the side of the guide walls 46, 47, 48. The guide walls 46, 47, 48 have wall surfaces 46*a*, 47*a*, 48*a* on the guide wall 45 side, respectively. The wall surface 45 is parallel to and faces the wall surfaces 46*a*, 47*a*, 48*a*. These walls surfaces 45*a*, 46*a*, 47*a*, 48*a* rise up vertically with respect to the conveying surface 40, and extend along the coin conveyance direction.

The passage unit 41 supports with the conveying surface 40 the bottom surface of the coins that are paid out from the coin insertion-payout unit 10 and guides their movement. The guide wall 45 and the guide walls 46, 47, 48 guide with the wall surface 45*a* and the wall surfaces 46*a*, 47*a*, 48*a* the outer circumferential surfaces of the coins so that the coins are lined up in a row during the guidance by the passage unit 41.

The guide wall 47 is movable in the horizontal direction perpendicular with the coin conveyance direction, that is, the passage width direction, with its position in the coin conveyance direction and vertical direction remaining the same. The wall surface 47*a*, while remaining in a parallel state with the wall surface 45*a*, moves back and forth so as to approach and move away from the wall surface 45*a*. The guide wall 47 moves in the passage width direction by a guide wall driving unit 51, and is stopped at a position corresponding to a denomination. That is, the guide wall driving unit 51 has a guide wall motor 52 that moves the guide wall 47 and a position detection sensor 53 such as an encoder that detects the position of the guide wall 47 (see FIG. 2).

Figure 3:
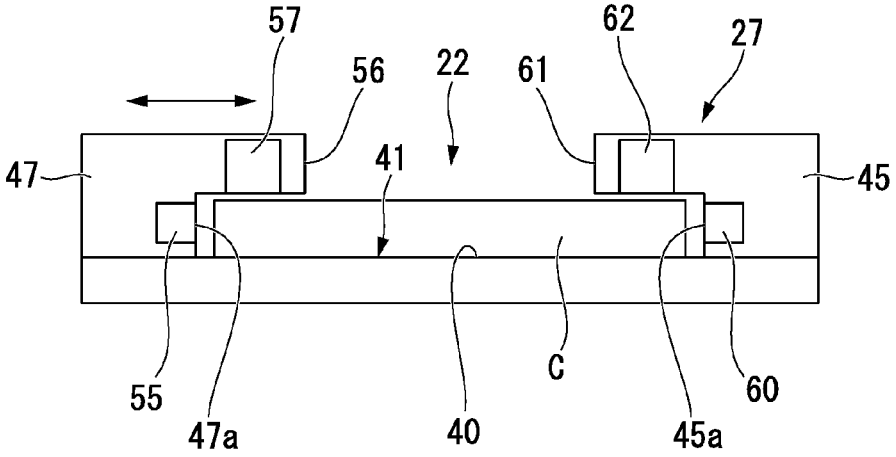
FIG. 3 is a cross-sectional view along A-A in FIG. 1 of the coin processing device according to the one embodiment of the present invention.

As shown in FIG. 3, the position sensor 55 is integrally provided at a position of the wall surface 47*a* in the guide wall 47. The detection direction of the position sensor 55 faces the guide wall 45. The position sensor 55 detects the position in the passage width direction of the facing portion at the outer circumferential surface of the coin C whose position agrees in the coin conveyance direction. The position sensor 55 is for example a reflection-type sensor that detects the distance with the outer circumferential surface of the opposing coin C whose position agrees in the coin conveyance direction.

The wall surface 47*a* has a projection unit 56 that projects toward the guide wall 45 at a position on the upper side of the wall surface 47*a*. A material sensor 57 is integrally provided in the projection unit 56. The material sensor 57 constitutes the aforementioned identifying unit 27 The position of the material sensor 57 is aligned with that of the position sensor 55 in the coin conveyance direction. The detection direction of the material sensor 57 is downward, that is, the direction faces the conveying surface 40. the material sensor 57 detects the magnetic property of the outer circumferential portion of the coin C that passes below.

The position sensor 60 is integrally provided at a position of the wall surface 45*a*. The detection direction of the position sensor 60 faces the guide wall 47. The position of the position sensor 60 is aligned with that of the position sensor 55 in the coin conveyance direction. The position sensor 60 detects the position in the passage width direction of the facing portion at the outer circumferential surface of the coin C whose position agrees in the coin conveyance direction. This position sensor 60 is for example a reflection-type sensor that detects the distance with the outer circumferential surface of the opposing coin C whose position agrees in the coin conveyance direction.

The wall surface 45*a* has a projection unit 61 that projects toward the guide wall 47 at a position on the upper side of the wall surface 45*a*. A material sensor 62 is integrally provided in the projection unit 61. The material sensor 62 constitutes the aforementioned identifying unit 27. The position of the material sensor 62 is aligned with the position sensor 60 in the coin conveyance direction. The detection direction of the material sensor 62 is downward, that is, the direction faces the conveying surface 40. The material sensor 62 detects the magnetic property of the outer circumferential portion of a coin that passes below.

The position sensor 55 and the material sensor 57 are arranged on the left side when viewed in the coin conveyance direction, while the position sensor 60 and the material sensor 62 are arranged on the right side when viewed in the coin conveyance direction. The material sensors 57 and 62 (first and second material sensors) form a pair, and this pair of material sensors 57 and 62 are provided spaced apart in the passage width direction and detect the material of the coin C being conveyed by the conveying unit 22. The position sensors 55 and 60 (first and second position sensors) form a pair, and this pair of position sensors 55 and 60 are provided spaced apart in the passage width direction and detect the position in the passage width direction of the coin C being conveyed by the conveying unit 22. The pair of material sensors 57 and 62 and the pair of position sensors 55 and 60 are provided with their positions aligned in the coin conveyance direction, in other words, seen from above, they are arranged on the same line perpendicular with the coin conveyance direction.

As shown in FIG. 2, the coin processing device 1 has an operation unit 70 that receives operation inputs of the operator, a display unit 71 that performs display toward the operator, a control unit (correcting unit, identifying unit) 72, and a storage unit 73. Upon one denomination that is selected from a plurality of denominations being set to the counting target denomination, the coin processing device 1 adjusts the interval between the mutually opposing guide walls 45 and 47 of the conveying unit 22 to the passage width corresponding to this counting target denomination. While conveying the coins C between these guide walls 45 and 47, the coin processing device 1 identifies with the material sensors 57 and 62 whether or not they are coins of this counting target denomination and counts them, and then sorts the coins of this counting target denomination to the receiving box 32 and the coins other than the counting target denomination to the reject box 31.

When the coin processing device 1 is in the standby state, the control unit 72 causes the display unit 71 to display a display prompting the input of a counting target denomination. Upon seeing this, the operator selects and inputs the counting target denomination with the operation unit 70. That is, the operation unit 70 receives the selection input of the counting target denomination. Specifically, the operation unit 70 is capable of receiving the input of a domination selected from a plurality of denominations such as a first denomination, a second denomination and so forth. When the operation unit 70 receives a selection input of for example the first denomination, the control unit 72 determines that one identification-counting process (identification process) has started and reads out the arrangement position data of the guide wall 47 for the first denomination from the storage unit 73. Hereinbelow, a description shall be given taking as an example the case of the first denomination having been selected in this way.

In the case of the current arrangement position data of the guide wall 47 agreeing with the arrangement position data read out from the storage unit 73, the control unit 72 leaves the position of the guide wall 47 as it is. In the case of the current arrangement position data of the guide wall 47 not agreeing with the arrangement position data read out from the storage unit 73, the control unit 72 drives the guide wall motor 52 of the guide wall driving unit 51 to cause the guide wall 47 to move and stop so that the position of the guide wall 47 detected by the position detection sensor 53 agrees with the position corresponding to the arrangement position data. Thereby, the guide wall 47 is arranged at a position corresponding to the outer diameter of the counting target denomination. That is, the conveying unit 22 has the mutually opposing guide walls 45 and 47 (first and second walls) that are adjusted to a passage width corresponding to the denomination selection input made to the operation unit 70. The passage width of the guide walls 45 and 47 may contain an error with respect to the set value.

Next, the control unit 72 causes the display unit 71 to display a display prompting the insertion of coins to the coin insertion-payout unit 10 and the input of a start operation to the operation unit 70. Upon seeing this, the operator inserts coins in the coin insertion-payout unit 10 and performs the start operation in the operation unit 70.

When the operation unit 70 receives the start operation, the control unit 72 drives the rotating disk motor 15 and the feed motor 36. Then, the rotating disk 12 rotates, and coins are carried along the inner circumferential surface of the cylindrical wall 13 by its centrifugal force, and are separated one by one via the gap between the rotating disk 12 and the separating ring 14 to be paid out sequentially from the coin insertion-payout unit 10 to the outside of the rotating disk 12. The coins that are paid out sequentially from the coin insertion-payout unit 10 are conveyed to the downstream side by the conveying belt 35 of the feed unit 21 of the conveying unit 22, while being guided in a row shape by the guide wall 45, the guide walls 46, 47, 48 and the conveying surface 40. That is, the conveying unit 22 conveys the coins C between the guide wall 45 and the guide walls 46, 47, 48 of the conveyance path 20.

After the control unit 72 judges one identification-counting process to have started, when the pair of position sensors 55 and 60 and the pair of material sensors 57 and 62 detect the first coin, the control unit 72 identifies this first coin based on the material detection data that the pair of material sensors 57 and 62 have detected. That is, the control unit 72 identifies this first coin by comparing the material detection data that the pair of material sensors 57 and 62 have detected with the data tolerance range for the first denomination stored in the storage unit 73. When the material detection data is within the data tolerance range for the first denomination, the control unit 72 determines that the first coin is a coin of the first denomination and sets the count value to 1. Moreover, the control unit 72 stores the position detection data detected by the position sensors 55 and 60 for this first coin in the storage unit 73 as reference data of this one identification-counting process. The control unit 72 controls such that this first coin is made to drop from the terminal position of the conveying unit 22 to the receiving box 32 without being made to drop from the rejection port 28.

On the other hand, if the material detection data detected by the pair of material sensors 57 and 62 is not within the data tolerance range for the first denomination, the control unit 72 causes the display unit 71 to display an error, stops the rotating disk motor 15 to stop the rotating disk 12 of the coin insertion-payout unit 10. Furthermore, the control unit 72 conveys by the conveying belt 35 all of the coins paid out from the coin insertion-payout unit 10 to the conveyance path 20, and causes them to drop from the rejection port 28 to the reject box 31 by the rejecting unit 29. When the time required for all the coins paid out to the conveyance path 20 to drop from the rejection port 28 has passed, the control unit 72 stops the feed motor 36 to stop the conveying belt 35.

In the one identifying-counting process, after the first coin is determined to be a coin of the first denomination, when the pair of position sensors 55 and 60 and the pair of material sensors 57 and 62 detect the second coin (conveyed coin), the control unit 72 corrects the material detection data of the pair of material sensors 57 and 62 based on the position detection data of the pair of position sensors 55 and 60 to obtain corrected material detection data. That is, based on the reference data of this one identification-counting process that is position detection data that the pair of position sensors 55 and 60 detected for the first coin as described above, and the position detection data that the pair of position sensors 55 and 60 detected for the second coin, the control unit 72 corrects the detection data of the pair of material sensors 57 and 62 for the second coin.

Specifically, the more separated a coin is, the higher the material detection data (voltage value) becomes in the material sensors 57 and 62, and the more separated a coin is, the higher the position detection data (voltage value) becomes in the position sensors 55 and 60. Therefore, if the position detection data is high, correction is performed so as to lower the material detection data.

Specifically, for the first coin, if the position detection data that the first position sensor 55 has detected is denoted as x0 and the position detection data that the second position sensor 60 has detected is denoted y0, the control unit 72 calculates a reference value b using the formula of b=y0+x0. Then, for the second coin, if the detection data that the first position sensor 55 has detected is denoted as x and the detection data that second position sensor 60 has detected is y, the control unit 72 calculates a calculation value a using the formula of a=y/x.

Then the control unit 72 calculates correction values difx and dify using the formula of difx=x−b/(a+1) and the formula of dify=y−a*b/(a+1). When the correction values difx and dify are calculated, the calculation value a and reference value b are used. The control unit 72 then performs correction in which the correction value difx is subtracted from the material detection data Dx of the first material sensor 57, and the correction value dify is subtracted from the material detection data Dy of the second material sensor 62. The first material sensor 57 is on the same side in the passage width direction as the first position sensor 55. The second material sensor 62 is on the same side in the passage width direction as the second position sensor 60. That is, the first material sensor 57 and the first position sensor 55 are provided on the opposite side of the conveying unit 22 from the second material sensor 62 and the second position sensor 60.

Figure 4A:
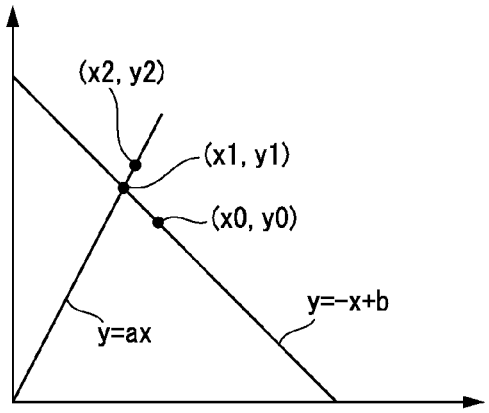
FIG. 4A is a diagram for describing a method of calculating correction values of the coin processing device according to the one embodiment of the present invention.
Figure 4B:
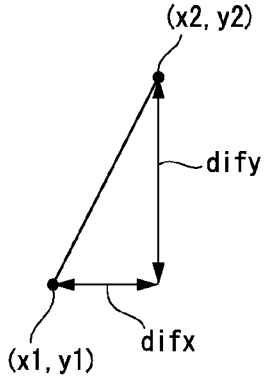
FIG. 4B is a diagram for describing the method of calculating the correction values of the coin processing device according to the one embodiment of the present invention.

That is to say, as shown in FIGS. 4A and 4B, for the first coin, the position detection data x0 that the position sensor 55 has detected and the position detection data y0 that the position sensor 60 has detected are plotted on an XY coordinate system, and the function of y=−x+b passing through this point (x0, y0) is found. For the second coin, the position detection data x2 that the position sensor 55 has detected and the position detection data y2 that the position sensor 60 has detected are plotted on the XY coordinate system, and the function of y=ax passing through this point (x2, y2) is found. The point (x1, y1) at which these lines intersect is found, and the correction values difx (=x2−x1) and dify (=y2−y1) are found. Then, correction is performed in which the correction value difx is subtracted from the material detection data Dx of the material sensor 57 that is on the same side as the position sensor 55 and the correction value dify is subtracted from the material detection data Dy of the material sensor 62 that is on the same side as the position sensor 60.

Based on the corrected material detection data, the control unit 72 identifies this second coin. That is, the control unit 72 compares the corrected material detection data with the data tolerance range for the first denomination stored in the storage unit 73. If the material detection data after correction is within the data tolerance range for the first denomination, the control unit 72 determines that the second coin is a coin of the first denomination, and adds one to the count value to make it 2. Moreover, the control unit 72 controls such that this second coin is dropped in the receiving box 32 from the terminal position of the conveying unit 22 without being dropped from the rejection port 28. On the other hand, if the material detection data after correction is not within the data tolerance range for the first denomination, the control unit 72 controls such that the second coin is dropped from the rejection port 28 into the reject box 31 by the rejecting unit 29 without being counted.

In this one identification-counting process, for the third and subsequent coins that the pair of position sensors 55 and 60 and the pair of material sensors 57 and 62 have detected, the control unit 72 corrects the material detection data in the same way as for the aforementioned second coin and performs identification based on the material detection data after being corrected. In the one identification-counting process, when the time in which the pair of position sensors 55 and 60 and the pair of material sensors 57 and 62 do not detect a coin reaches a prescribed time, the control unit 72 causes the display unit 71 to display the count value and stops the rotating disk motor 15 to stop the rotating disk 12 of the coin insertion-payout unit 10. Furthermore, when the time required for all of the coins that have been paid out from the coin insertion-payout unit 10 to drop from the rejection port 28 or the terminal of the conveying unit 22 has elapsed, the control unit 72 stops the feed motor 36 to stop the conveying belt 35, and determines that the one identification-counting process has ended.

According to the coin processing device 1 of the present embodiment described above, the pair of material sensors 57 and 62 that are provided spaced apart in the passage width direction and detect the material of a coin being conveyed by the conveying unit 22, and the pair of position sensors 55 and 60 that are provided spaced apart in the passage width direction and detect the position in the passage width direction of a coin being conveyed by the conveying unit 22 are provided with their positions aligned in the coin conveyance direction. The control unit 72 corrects the detection data of the pair of material sensors 57 and 62 based on the detection data of the pair of position sensors 55 and 60, and identifies a coin based on this corrected data. Thereby, even in the case of the adjustment accuracy being insufficient when the passage width of the conveying unit 22 is adjustable, it is possible to inhibit a drop in the identification accuracy.

Also, in the one identification-counting process, since the control unit 72 has the detection data that the pair of position sensors 55 and 60 have detected for the first coin serve as reference data, it is possible to make the detection data of a coin that has actually been conveyed in the passage width that has been adjusted of the conveying unit 22 serve as the reference data. Thereby, the reference data conforms to the actual passage width, and it is possible to further inhibit a drop in the identification accuracy.

Also, for the first coin the control unit 72 finds the reference value b (=y0+x0) from the position detection data x0 that the position sensor 55 has detected and the position detection data y0 that the position sensor 60 has detected. Moreover, for the second coin the control unit 72 calculates the calculation value a (=y/x) from the detection data x that the position sensor 55 has detected and the detection data y that the position sensor 60 has detected. Furthermore, the control unit 72 calculates the correction values difx (=x−b/(a+1)) and dify (=y−a*b/(a+1)) from the calculation value a and the reference value b. The control unit 72 then performs correction in which the correction value difx is subtracted from the material detection data Dx of the material sensor 57 and the correction value dify is subtracted from the detection data Dy of the material sensor 62. Thereby, it is possible to comparatively easily and appropriately correct the detection data of the material sensors 57 and 62.

Note that it is also possible to adopt the following method as a method for correcting the material detection data of the pair of material sensors 57 and 62 based on the position detection data of the pair of position sensors 55 and 60.

For the first coin, letting the position detection data that the first position sensor 55 has detected be x0 and the position detection data that the second position sensor 60 has detected be y0, the control unit 72 calculates the reference value b using the formula of b=y0+x0. Then, for the second coin, letting the detection data that the first position sensor 55 has detected be x and the detection data that the second position sensor 60 has detected be y, the control unit 72 calculates a calculation value c using the formula of c=y−x.

The control unit 72 calculates correction values difx and dify using the formulas of difx=x−(b−c)/2 and dify=y−(b+c)/2 from this calculation value c and reference value b. Moreover, the control unit 72 performs correction in which the correction value difx is subtracted from the material detection data Dx of the first material sensor 57 that is on the same side in the passage width direction as the first position sensor 55, and the correction value dify is subtracted from the material detection data Dy of the second material sensor 62 that is on the same side in the passage width direction as the second position sensor 60.

Figure 5A:
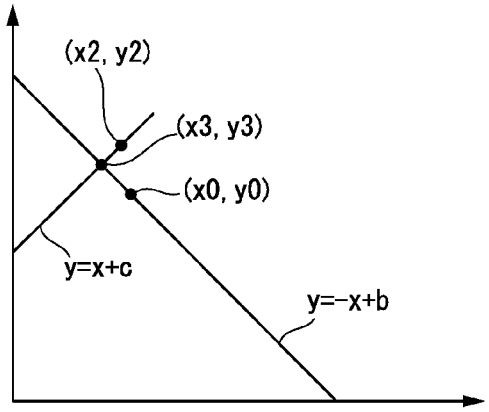
FIG. 5A is a diagram for describing another method of calculating correction values of the coin processing device according to the one embodiment of the present invention.
Figure 5B:
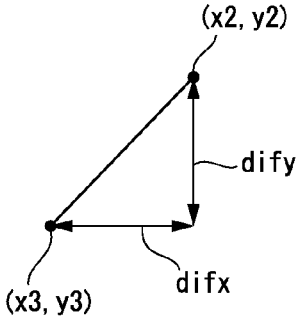
FIG. 5B is a diagram for describing the other method of calculating the correction values of the coin processing device according to the one embodiment of the present invention.

That is to say, as shown in FIGS. 5A and 5B, for the first coin, the position detection data x0 that the position sensor 55 has detected and the position detection data y0 that the position sensor 60 has detected are plotted on an XY coordinate system, and the function of y=−x+b passing through this point (x0, y0) is found. For the second coin, the position detection data x2 that the position sensor 55 has detected and the position detection data y2 that the position sensor 60 has detected are plotted, and the function of y=x+c passing through this point (x2, y2) is found. Then the point (x3, y3) at which these lines intersect is found. Then, the correction values difx (=x2−x3) and dify (=y2−y3) are found. Moreover, correction is performed in which the correction value difx is subtracted from the material detection data Dx of the first material sensor 57 that is on the same side in the passage width direction as the first position sensor 55 and the correction value dify is subtracted from the material detection data Dy of the second material sensor 62 that is on the same side in the passage width direction as the second position sensor 60. Even by this method, it is possible to comparatively easily and appropriately correct the detection data of the material sensors 57 and 62.

Also, in the one identification-counting process given above, the position detection data that the pair of position sensors 55 and 60 have detected for the first coin is made to serve as the reference data, and based on this reference data and the position detection data that the pair of position sensors 55 and 60 have detected for the second and subsequent coins, the detection data of the pair of material sensors 57 and 62 for the second and subsequent coins is corrected. In contrast, while the reference data for calculating the correction data of the second coin is based on the position detection data that the pair of position sensors 55 and 60 detected for the first coin, as the coins that are identified as coins of the counting target denomination increase in number, the average value of the position detection data that the pair of position sensors 55 and 60 have detected for all of those coins or a plurality of coins sampled therefrom may serve as the reference data.

The coin processing device 1 given above is suitable for use in identifying and counting coins in which specifically the radial direction inner side and radial direction outer side are made of different materials.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A coin processing device comprising:

an operation unit that receives an input of a denomination;

a conveying unit that conveys a coin in a conveyance direction, the conveying unit including first and second guide walls opposing to each other in a passage width direction substantially orthogonal to the conveying direction, the first and second guide walls sandwiching the conveyed coin therebetween, an interval between the first and second guide walls being adjusted to a passage width corresponding to the inputted denomination;

first and second material sensors that are provided spaced apart in the passage width direction, positions of the first and second material sensors being aligned with each other in the conveyance direction, the first and second material sensors detecting material of the conveyed coin to obtain material detection data related to the conveyed coin;

first and second position sensors that are provided spaced apart in the passage width direction, positions of the first and second position sensors being aligned with the positions of the first and second material sensors in the conveyance direction, the first and second position sensors detecting a position of the conveyed coin in the passage width direction to obtain position detection data related to the conveyed coin;

a correcting unit that corrects the material detection data based on the position detection data to obtain corrected material detection data; and an identifying unit that identifies the conveyed coin based on the corrected material detection data.

2. The coin processing device according to claim 1, wherein the conveyed coin is a second coin, the conveying unit further conveys a first coin, the first and second position sensors detect the first coin to obtain position detection data related to the first coin, and the correcting unit uses the position detection data related to the first coin as reference data in one identification process, and corrects the material detection data related to the second coin based on the reference data and the position detection data related to the second coin.

3. The coin processing device according to claim 2, wherein the first material sensor and the first position sensor are provided on an opposite side of the conveying unit from the second material sensor and the second position sensor, the position detection data related to the first coin includes: position detection data related to the first coin obtained by the first position sensor, which is denoted as x0; and position detection data related to the first coin obtained by the second position sensor, which is denoted as y0, the position detection data related to the second coin includes: position detection data related to the second coin obtained by the first position sensor, which is denoted as x; and position detection data related to the second coin obtained by the second position sensor, which is denoted as y, the material detection data related to the second coin includes: material detection data related to the second coin obtained by the first material sensor, which is denoted as Dx; and material detection data related to the second coin obtained by the second material sensor, which is denoted as Dy, the correcting unit calculates reference value b using a formula of b=y0+x0, the correcting unit calculates a calculation value a using a formula of a=y/x, the correcting unit calculates correction values difx and dify using a formula of difx=x−b/(a+1) and a formula of dify=y−a*b/(a+1), and the correcting unit subtracts the correction value difx from the material detection data Dx and subtracts the correction value dify from the material detection data Dy, as the correction of the material detection data related to the second coin.

4. The coin processing device according to claim 2, wherein the first material sensor and the first position sensor are provided on an opposite side of the conveying unit from the second material sensor and the second position sensor, the position detection data related to the first coin includes: position detection data related to the first coin obtained by the first position sensor, which is denoted as x0; and position detection data related to the first coin obtained by the second position sensor, which is denoted as y0, the position detection data related to the second coin includes: position detection data related to the second coin obtained by the first position sensor, which is denoted as x; and position detection data related to the second coin obtained by the second position sensor, which is denoted as y, the material detection data related to the second coin includes: material detection data related to the second coin obtained by the first material sensor, which is denoted as Dx; and material detection data related to the second coin obtained by the second material sensor, which is denoted as Dy, the correcting unit calculates reference value b using a formula of b=y0+x0, the correcting unit calculates a calculation value c using a formula of c=y−x, the correcting unit calculates correction values difx and dify using a formula of difx=x−(b−c)/2 and a formula of dify=y−(b+c)/2, and the correcting unit subtracts the correction value difx from the material detection data Dx and subtracts the correction value dify from the material detection data Dy, as the correction of the material detection data related to the second coin.

5. The coin processing device according to claim 2, wherein the first and second material sensors and the first and second position sensors detect the first coin before detecting the second coin.

6. The coin processing device according to claim 2, wherein the conveying unit further conveys a third coin, the first and second material sensors detect the third coin to obtain material detection data related to the third coin, the first and second position sensors detect the third coin to obtain position detection data related to the third coin, and the correcting unit uses an average value of the position detection data related to the first coin and the position detection data related to the second coin, and corrects the material detection data related to the third coin based on the average value and the position detection data related to the third coin.

* * * * *